United States Patent [19]

Metzger

[11] Patent Number: 4,838,465

[45] Date of Patent: Jun. 13, 1989

[54] GUIDE BAR FOR A HOSE WHICH IS PHYSICALLY MANIPULATED BY WORKERS TO DELIVER A HIGH DENSITY MATERIAL TO A PREDETERMINATED SITE

[76] Inventor: Lynn Metzger, 4860 Dungan Rd., Circleville, Ohio 43113

[21] Appl. No.: 866,116

[22] Filed: May 22, 1986

Related U.S. Application Data

[63] Continuation-in-part of Ser. No. 500,302, Jun. 2, 1983, abandoned.

[51] Int. Cl.[4] ..... A62C 23/04

[52] U.S. Cl. ..... 222/526; 248/75; 294/16

[58] Field of Search ..... 222/74, 191, 526–527, 222/174, 465.1; 248/75–78; 294/15–16; D8/303; 24/273; 59/85–86, 93

[56] References Cited

U.S. PATENT DOCUMENTS

| | | | |
|---|---|---|---|
| 57,886 | 9/1866 | Frentz | 248/78 |
| 128,155 | 6/1872 | Lowe | 294/16 |
| 195,940 | 10/1877 | Martin | 59/85 |
| D. 242,984 | 1/1977 | Petty | D8/303 |
| 251,996 | 1/1882 | Callahan | 248/78 |
| 297,788 | 4/1884 | Green | 294/16 |
| 601,639 | 5/1898 | Doyle | 294/16 |
| 666,474 | 1/1901 | De Wolfe | 294/16 |
| 877,012 | 1/1908 | Sullivan . | |
| 918,159 | 4/1909 | Jenkins | 248/78 |
| 1,058,926 | 4/1913 | Toole | 294/16 |
| 1,094,332 | 4/1914 | Hubbard | 24/273 X |
| 1,512,003 | 10/1924 | McGeary | 294/16 |
| 1,829,621 | 10/1931 | Whiteford | 248/75 |
| 1,925,431 | 9/1933 | Bishop | 138/103 |
| 2,846,259 | 8/1958 | Sadler | 294/15 |
| 3,211,337 | 10/1965 | Loveall, Jr. et al. | 222/74 |
| 3,727,962 | 4/1973 | Reisinger | 294/16 |
| 3,747,972 | 7/1973 | Mespelt | 294/118 |
| 4,072,369 | 2/1978 | Segreto | 175/325 |
| 4,116,374 | 9/1978 | Garello | 294/150 |

FOREIGN PATENT DOCUMENTS

| | | | |
|---|---|---|---|
| 546813 | 7/1942 | United Kingdom | 248/76 |

*Primary Examiner*—Michael S. Huppert

*Attorney, Agent, or Firm*—Porter, Wright, Morris & Arthur

[57] ABSTRACT

A guide bar for use by workers involved in the manipulation of a hose which carries a high density material to a predetermined site. The bar is preferably used in the building trades by a work gang involved in the delivery of concrete. The guide bar includes a clamp for attachment to the hose, the bar itself which includes handle grasping means and a flexible connection between the clamp and the bar.

7 Claims, 4 Drawing Sheets

31
33
50
30
32
24
51
26
27
41
42
43
40

20
25
21
22
23
1
2
6
11
12
3
5
7
13
4
TO CLOSE 51
27
25
21
22
23
6
6
12
101
7
5
5
13
4

GUIDE BAR FOR A HOSE WHICH IS PHYSICALLY MANIPULATED BY WORKERS TO DELIVER A HIGH DENSITY MATERIAL TO A PREDETERMINATED SITE

This application is a continuation-in-part of application Ser. No. 500,302, filed June 2, 1983, now abandoned.

FIELD OF THE INVENTION

This invention relates to the building and construction trades and to hose guide means for the delivery of a high density material, such as concrete, to a predetermined location at a work site.

BACKGROUND OF THE PRIOR ART

In any commercial and large scale construction projects, concrete is delivered for pouring at given locations by means of a hose through which the concrete is conveyed either by a gravity force or pumping means for delivery to a predetermined location, such as a building form. The hose is a generally flexible, circular tube, usually of the order of about 4 inches in diameter formed from a flexible material such as reinforced fiber which is capable of withstanding the abrasive force of continuous concrete flow. Such a hose is generally manipulated by several construction workers, i.e. a work gang, who guide the hose and its delivery of concrete to the intended form such as a foundation, wall, pillar or other feature of the building to be formed from poured concrete.

As a well know, concrete has a very high weight per unit volume. In the delivery of concrete by means of a hose, it is extremely difficult for the gang of workers to manipulate the concrete delivery hose because of the weight of the concrete in the hose and also because of the momentum induced in the hose caused by the motion of the concrete through the hose. Usually a gang of up to four or more workers is required to control and to hold the delivery hose in place typically using chains or ropes as guides for the hose. Work on such a gang is physically demanding and fatiguing. As a matter of common sense, the difficulty in holding a chain or rope for an extended period of time during a work day—even if gloves are used—is plainly evident. Thus, such concrete hose "gangs" require frequent rest and personnel replacement.

OBJECTS OF THE INVENTION

It is an object of this invention to provide an improved means by which a construction worker on a hose gang is able to hold, control and manipulate a concrete delivery hose. It is a further object to provide a bar guide for a concrete delivery hose which includes a flexible connecting means between a clamp which attaches to the hose and the bar handle.

It is thus a useful object of the invention to enhance worker comfort and convenience in a construction task which heretofore has been considered exceedingly physically demanding, tiresome and difficult.

It is also an object to provide means by which the number of workers required in a gang to hold a concrete delivery hose may be reduced and the physical demands of the job lessened. This results because of the mechanical advantage and workers comfort attained when the bar guide is connected and clamped to the hose.

It is also an object of the invention to provide a manually manipulable guide means for a hose in a hose delivery system in which a high density bulk material is delivered under a force through the hose to a predetermined location.

These and other objects of the invention will be apparent from the following description of the preferred embodiment, taken in conjunction with the drawings in which:

DESCRIPTION OF THE PREFERRED EMBODIMENT

Figures 1, 2:
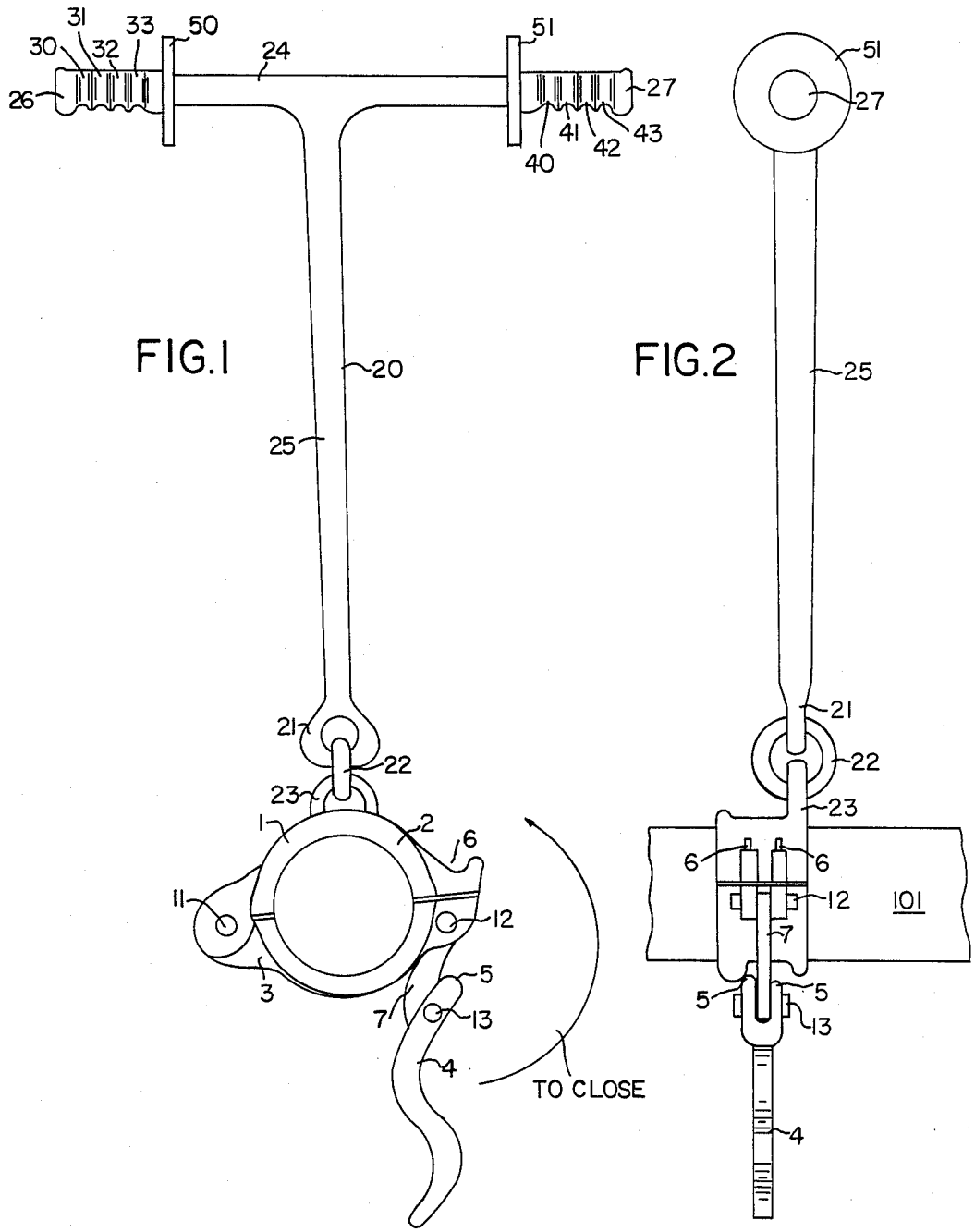
FIG. 1 shows a front elevation of the bar hose guide.
FIG. 2 shows a side elevation view of the bar shown in FIG. 1.

With reference to FIG. 1, the preferred embodiment of the invention includes means for flexibly attaching a rigid manually manipulable guide means to a hose in which the manually engageable portion of the guide means is maintained a distance from the point of flexible connection to the hose.

Thus, in FIG. 1, there is shown a first clamp means, 1, which is circumferentially engageable with the outer diameter of a segment of a tubular hose. While the term "hose" is used and usually has reference to a flexible tube type structure, it is evident that an overall hose delivery system may include rigid connections between hose segments or extended nozzles at the end thereof to which interconnection with the clamp means may be appropriate.

The clamp means 1, includes oppositely facing semicircular hinged segments, 2 and 3 engagable around the outer dimension of a hose. The segments are fixedly attachable to one another at the side thereof opposite the "hinged" side by corresponding engagement means including a lever 4 and tooth 5 and groove 6 engagement means. The lever is flexibly interconnected to the clamp segment by extended joining means 7. Hinge pins of the clamp are shown at 11, 12 and 13. Such a type of clamp shown is commercially available and it is evident that other types of clamping means of suitable durability and strength may be equivalently substituted to provide a firm connection to the hose support.

The clamp includes a means for flexible interconnection to the manually manipulable guide means of the invention such as a T-bar of one preferred embodiment. In FIG. 1, the bar is shown at 20 and includes at the lower end thereof an intrinsically formed first loop 21 connected by link means 22 which in turn is engaged to a corresponding loop 23 attached intrinsically to the clamp. The bar shown includes a crossing segment 24 which oppositely extends approximately equidistantly from both sides of the stem segment of the T, 25. At the ends of the cross segment 24, there are included handle gripping means 26 and 27 which may include ridge segments such as indicated at 30, 31, 32, 33 and the like or finger indentations indicated at 40, 41, 42 and 43 which facilitate a worker's grasping of the handle and- /or provide a physiologically appropriate surface conformable to a presenting hand grip which the guide bar is in use. Generally, the handle segment of the crossing bar is the same at both ends. The handle segments terminate in a disk shaped guard shown at 50 and 51 at each side of the crossing bar.

A side elevation view of the bar is shown in FIG. 2 in which corresponding numbers indicate the same elements as are shown in FIG. 1. In FIG. 2, however, the clamp means, tooth 5 and groove 6 are shown in greater detail. When the clamp is engaged, the lever handle 4 raises segment 7 to the other section of the clamp and the tooth 5 engages groove 6 as the lever secures the joint. Engagement of the clamp is indicated by movement of lever 4 in the direction shown by the curved arrow.

While the flexible interconnection between the bar and the hose clamp is shown as embodying co-operating loops 21 and 23 joined by ring 22, it is evident that such means need not be circular, but may include links of other regular, extended means which will allow at least bi-axial movement of the hose clamp around the tip of the bar such as for example, a ball joint, hinge means, chain link and the like.

Figure 3:
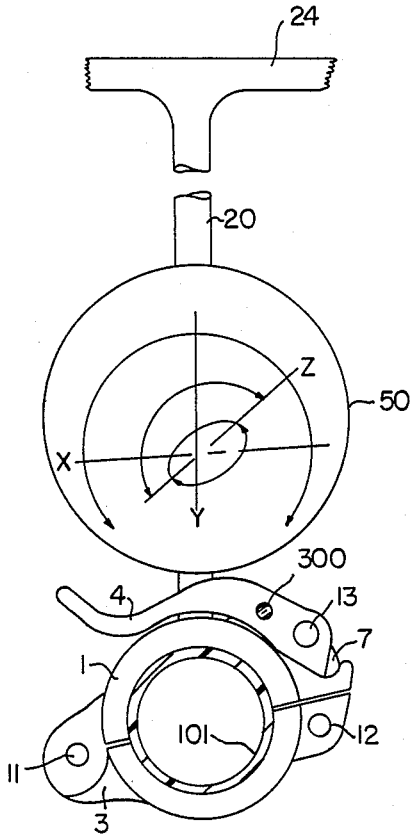
FIG. 3 shows the range of possible rotational relationships allowed by the flexible interconnection between the hose and the lower end of the bar stem.

FIG. 3 shows a preferred range of rotational relationships permitted by the flexible interconnection between the hose clamp and the lower end of the bar stem. A depiction of a three dimensional X, Y, Z axis is shown in detail at 50 in lieu of the linked flexible interconnection shown in FIGS. 1 and 2; the clamp is shown in its "closed" position engaging a section of hose 101. For purposes of explanation, it is considered that the hose passes through the axis center and lies along the Z axis of the three dimensional system. Thus, the bar rotates approximately 180 degrees along the Y, Z plane, more than 180 degrees in the X, Y plane and may also "twist" around the Y axis in the X, Z plane. It can be seen that relative rotation of the bar with respect to a fixed clamp at a given location on the hose should occur about at least two axes considering as a center.

Figure 3A:
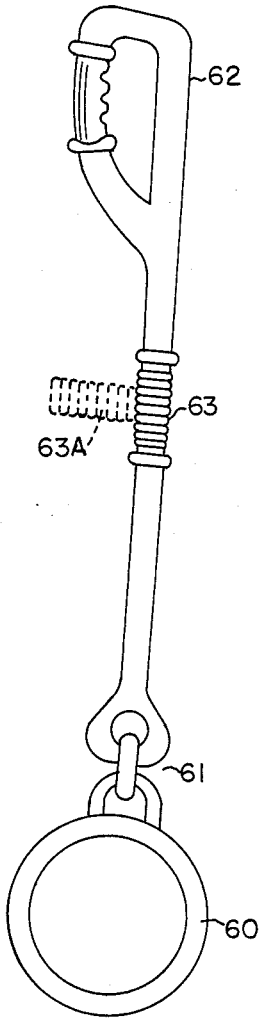
FIG. 3A shows an alternate handle configuration.

When considerations of proper working posture are taken in conjunction with the rotatable connection to the hose, it is also possible that grips can be provided as handles at the "T" end of the cross bar and in the center position of the bar stem. Such an alternate gripping configuration is shown in FIG. 3A, showing hose clamp 60, flexible linkage 61 and a grip at the upper end of the bar at 62 and the other grip at the central section of the bar at 63 or 63A. Thus, holding configurations for the bar may be individually tailored to provide the greatest degree of comfort to a worker. While this embodiment is not a literal "T" shape, it can be seen that the two grips occur on segments of an imaginary "T" shape; and the overall bar comprises essentially a section of an extended "T" shape.

Figure 5:
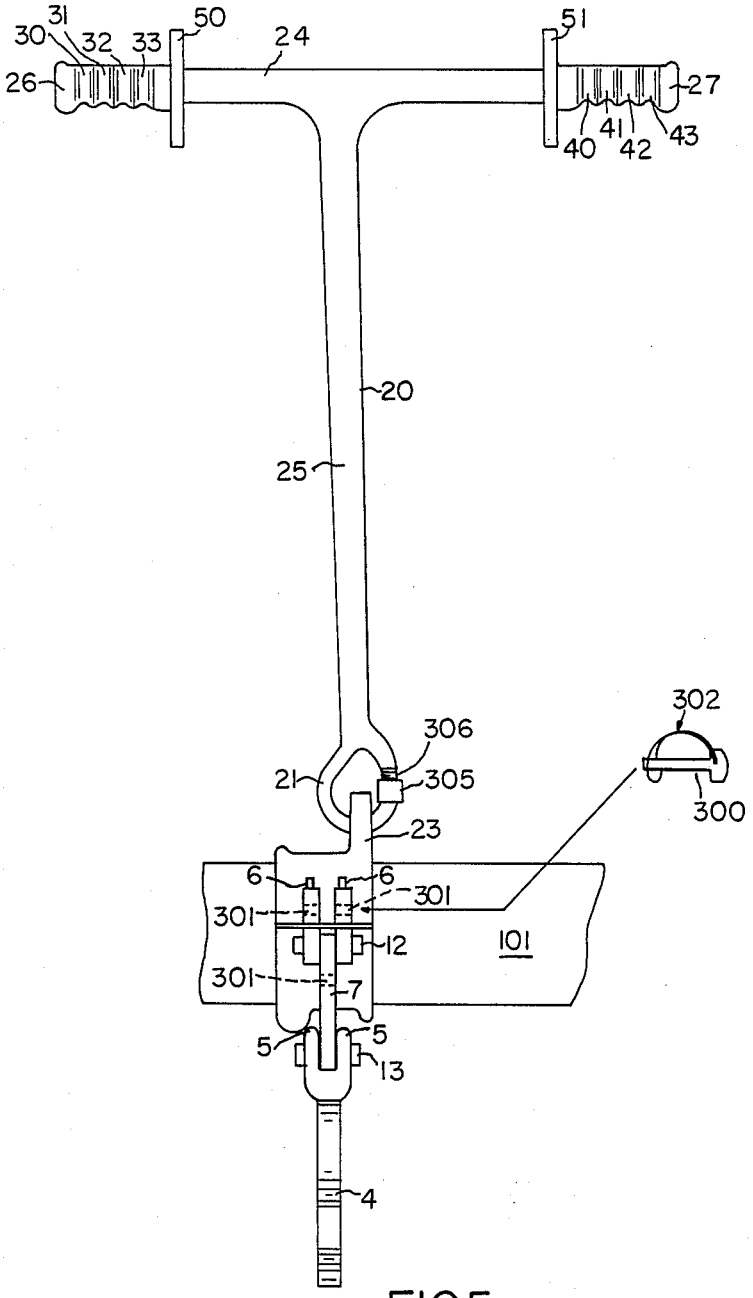
FIG. 5 shows a preferred embodiment having an interlocking ring connection and a safety pin lock.

FIG. 5 shows a preferred embodiment which does not include the link means 22, but rather interlocks the intrinsically formed loop 21 with the corresponding loop 23 intrinsically formed as part of the clamp. Also, FIG. 5 shows a safety pin 300, which is inserted through holes 301 in the groove engagement 6 and the extended joining means 7 and prevents unintentional opening of the clamp. A stiff but flexible loop of wire 302 is attached to at the "head" end of the safety pin with the opposite end of the wire such that it can be looped over the "non-head" end such that after the safety pin is inserted in the clamp, the stiff wire loop is placed over the "non-head" end, thereby preventing the safety pin from unintentionally slipping out. Optionally, loop 21 or 23 may include an open gap segment secured by a threaded nut or other device so that "T" bar and hose clamp elements may be changed. A threaded nut 305 on loop threads 306 is shown in FIG. 5 closing a gap in loop 21.

Figure 4:
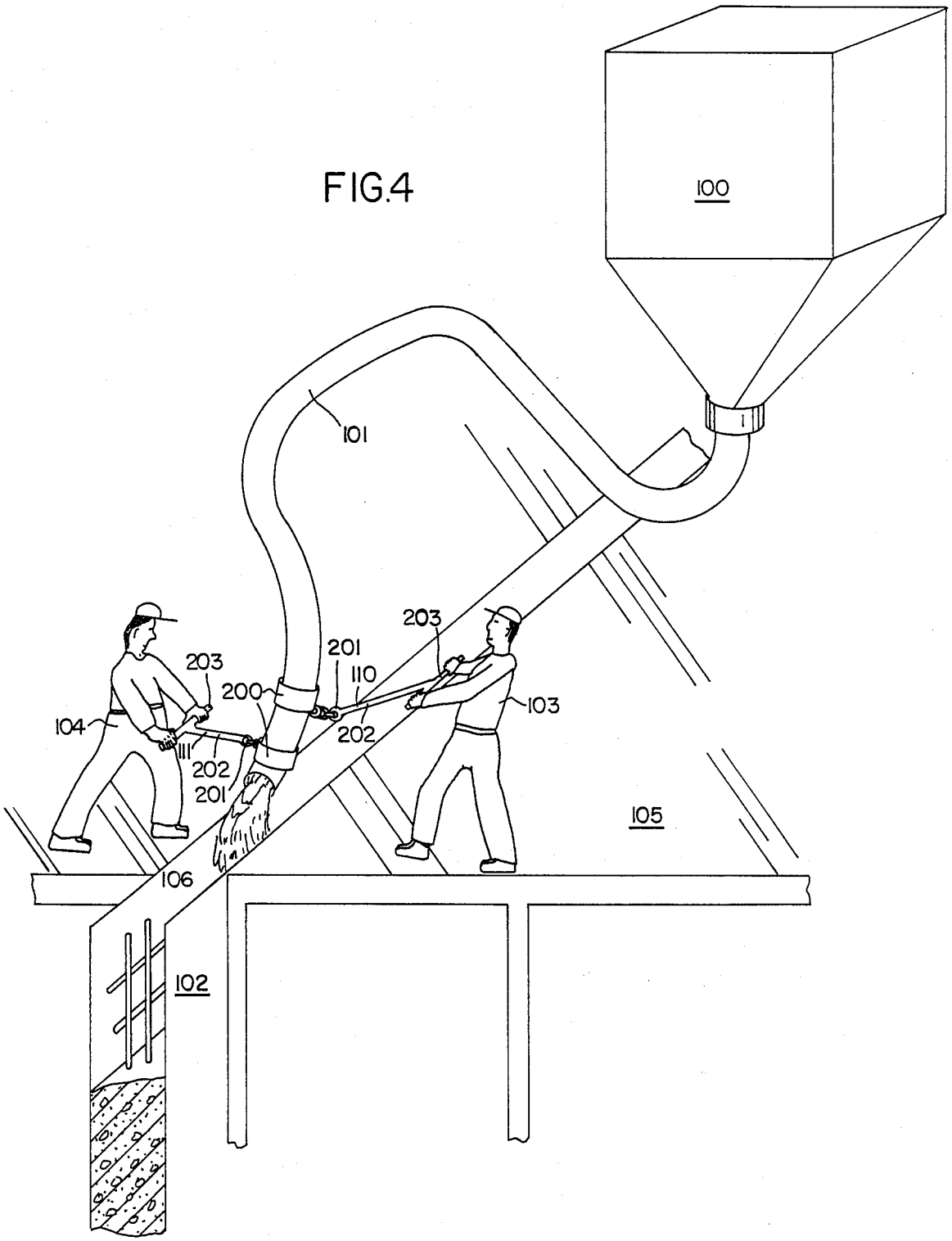
FIG. 4 shows use of the guide bar at a concrete pour site at a construction location.

Operation of the invention is shown in FIG. 4 wherein concrete from a hopper 100 is to be delivered through hose 101 to a building form 102 which is at a distance from the hopper. Workers 103 and 104 are shown on a working surface 105. The bar hose guides of the invention such as shown in FIGS. 1 and 2 are affixed to the hose at the end of the hose distant from the concrete source and proximate the constuction site location at which the concrete is to be delivered. The concrete being poured is shown flowing from the delivery end of the hose at 106. A gravity fed system is shown although pumped or other systems which force concrete through the hose are also known. The bar guides thus shown in FIG. 4 include the clamp means 200 for securing connection around the outer diameter of the hose, flexible interconnection means 201 between the clamp and the stem 202 of the bar, and bar crossing means 203 which are held at each end by the two hands of the construction workers. The bar guides are thus manipulated in coordination by the work gang to guide the delivery end of the hose to the form which is to receive the concrete. In this manner it can be seen that the guide of the invention allows the workers to be separated a predetermined distance from each other and from the hose. The workers are comfortably spaced and the bar means allows further flexible manipulation of the hose to guide the delivery concrete. Using the bar guide, the workers my assume a more physiologically comfortable and secure stance than would be possible if ropes or chains were used. The depiction of FIG. 4 is of course figurative rather than literal and it is evident that horizontal and pumped delivery of concrete through the hose and different numbers of workers may be used in a hose gang employing the guide of the invention.

While it is assumed that the term "concrete" as used herein will have a self evident meaning to persons engaged in the building construction trades, it is intended in a more scientific manner that "concrete" refer to the building material formed from a cementing material such as portland cement and a mineral aggregate such as sand and gravel, which before setting is delivered to the site in a flowable or slurry form. Thus, while optimum use of the guide bar means of the invention is in the building trades for the delivery of concrete, it is apparent that such means may also be useful for hose systems in which (1) other materials such as slurries or aggregates having a high density are delivered under a force by a hose to a predetermined site and (2) it is necessary that the delivery end of the hose be periodically changed in location by a laborer or work gang. Actual dimensions of the various members of the guide bars are not critical and it is evident they should be physiologically sized appropriate to their function.

What is claimed is:

1. A guide bar for the positioning of a hose used for the delivery of a high density concrete-like material to a predetermined location which facilitates the carrying, lifting and positioning of the hose to dispense the material at a predetermined location comprised of:

(A) a rigid "T" shaped bar terminating at one end with the crossing portion of the "T" and having handle means for grasping and holding the bar at each end of the crossing portion of the "T"; said bar having at the lower end opposite the crossing portion of the "T", a first loop, integrally molded and rigidly connected to the lower end of the "T" bar to interconnect the lower end of said "T" bar to a hose clamping means;

(B) a molded second loop connecting the loop of the lower end of the "T" bar to a hose clamping means, said second loop allowing controllable bi-axial rotational movement between the lower end of the "T" bar and the hose clamping means at the point of connection of the two loops; and (C) a hose clamping means comprising a cylindrically shaped clamping means having a closing latch mechanism that securely attaches the clamp to the hose at a predetermined position on the hose and including a loop on a top side thereof integrally molded and rigid to the hose clamping means, said loop on the hose clamping means being the second loop that is interconnected to the corresponding loop connected to the loop on the lower end of the "T" bar.

2. The apparatus of claim 1 in which the connection between the lower end of the "T" bar and the hose clamping means consists of an additional loop formed as a single link member connecting the first and second loop shaped members which respectively integrally extend from the "T" bar and the hose clamping means.

3. The apparatus of claim 1 in which the concrete-like high density material is a pumped, poured concrete material.

4. Apparatus for use by a gang of construction workers to control the delivery of pumped concrete from a concrete supply through a hose to a predetermined site for pouring at a construction location to produce an intended form including:

(a) a supply of concrete;

(b) a hose through which the concrete is flowable, said hose operatively connected to the concrete supply and extending from the concrete supply to a site adjacent the location at which the concrete is to be delivered for pouring to produce the form;

(c) means for forcing the concrete through the hose; and (d) a plurality of "T" bar guide means connected at spaced intervals to the hose, at locations on the hose proximate to the end of the hose adjacent the delivery site for the concrete, said bar guide means including:

(A) a rigid "T" shaped bar terminating at one end with the crossing portion of the "T" and having handle means for grasping and holding the bar at each end of the crossing portion of the "T"; said bar having, at the end opposite the crossing portion of the "T", a first loop integrally molded and rigidly connected to the stem end of the "T" bar to interconnect the stem end of said "T" bar to a hose clamping means;

(B) a molded second loop connecting the loop at the stem end of the "T" bar to a hose clamping means, said loop allowing controllable bi-axial rotational movement between the stem end of the "T" bar and the hose clamping means at the point of connection of the two loops; and (C) a plurality of hose clamping means separately connected to the hose at the spaced intervals on the hose, said clamping means comprising a cylindrical shaped clamp having a closing latch mechanism that securely attaches the clamp to the hose and each including on a segment thereof a loop on the top side thereof integrally molded and rigid to the hose clamping means, each said loop on the hose clamping means being interconnected to a corresponding loop connected to the loop on the stem end of each "T" bar.

5. The apparatus of claim 4 in which the connection between the stem end of the "T" bar and the hose clamping means comprises a third loop interconnecting the loop intergrally molded to the stem end of the "T" bar and the loop integrally molded to the clamping means.

6. The combination of claim 5 including a clamp latch in the clamping means and a safety pin means cooperative with a hole in the latch of the hose clamping means for preventing inadvertent opening of the hose clamp.

7. The combination of claim 6 in which the connecting third loop between the "T" bar and clamp includes a securable gap to permit removal of the bar from the clamp.

* * * * *